United States Patent [19]

Ruch et al.

[11] 4,419,951

[45] Dec. 13, 1983

[54] FEEDER DEVICE FOR A SEWING MACHINE

[75] Inventors: Urs Ruch, Berlingen; Ernst Dreier, Steckborn, both of Switzerland

[73] Assignee: Fritz Gegauf Aktiengesellschaft Bernina-Nähmaschinenfabrik, Steckborn, Switzerland

[21] Appl. No.: 207,783

[22] Filed: Nov. 18, 1980

[30] Foreign Application Priority Data

Dec. 3, 1979 [CH] Switzerland ..... 10730/79

[51] Int. Cl.[3] ..... D05B 27/02

[52] U.S. Cl. ..... 112/323

[58] Field of Search ..... 112/303, 323

[56] References Cited

U.S. PATENT DOCUMENTS 2,783,725 3/1957 Eguchi ..... 112/323

FOREIGN PATENT DOCUMENTS 350128 6/1931 Fed. Rep. of Germany ..... 112/323
1907749 9/1969 Fed. Rep. of Germany .
342456 12/1959 Switzerland .

*Primary Examiner*—Wm. Carter Reynolds

*Attorney, Agent, or Firm*—Birch, Stewart, Kolasch & Birch

[57] ABSTRACT

A feeder device for a sewing machine containing a stitch plate and provided with a material feeder which reaches through the stitch plate from below, and which is driven by a lift- and thrust rocker along a path made up of four phases. The feeder device further includes a support member and an intermediate rocker. The support member of the material feeder is arranged on the intermediate rocker, which in turn is rotatingly attached to the thrust rocker whereby the horizontal rotational axis of the support member is arranged on the intermediate rocker at a distance from the rotational axis of the intermediate rocker and substantially parallel thereto. The intermediate rocker is, along with the support member, set in vertically oscillating motion and rotated around its rotational axis by a direct connection with the lift rocker which, through proper correction, provides a movement path to the material feeder, made up of the lift and thrust movements consisting of a lift and a thrust component which are transferred to the support member in an approximately rectangular form in the effective area.

3 Claims, 10 Drawing Figures

FEEDER DEVICE FOR A SEWING MACHINE

BACKGROUND AND SUMMARY OF THE INVENTION

The present invention is directed to a feeder device on a sewing machine with a material feeder which reaches through the stitch plate from below and is driven by a lift- and thrust rocker along a path made up of four phases.

With feeder devices known from Swiss Pat. No. 342,456, for example, a cam controls, in each case, the upward or upwardly directed lifting motion and the forward or backward thrust movement of the material feeder, whereby movement is transferred from the cams through the rocker arms and lift and thrust rockers, securely connected to these and engaging on the support of the material feeder. This drive method moves the material feeder in a nearly parallelogram-shaped path (with stitch lengths > zero). However, the transitions between the straight line lift segment and the straight line horizontal thrust movement of the effective part, i.e. lying above the stitch plate, of the material feeder movement path are relatively long arcs. This is a result of the partial superimposition of the lift and pivot movements and the swinging of the material feeder support around the horizontal axis of the thrust rocker. However, not only the movement effectiveness of the material feeder in these transition curves of the material feeder path is reduced, making it impossible to exactly determine the beginning and end of transport, but the thrust lengths with forward and reverse stitches also do not correspond exactly. The effective thrust length should, however, be exactly identical in both directions regardless of the selected material feed direction. The limited space within the sewing machine arm makes it necessary to cramp the components of the feeder device, which is also disadvantageous to its movement path, because the suspension point of the material feeder support to the thrust rocker must necessarily lie very close to the material feeder. Indeed, an attempt has already been made, e.g. according to the German Offenlegungsschrift No. 19 07 749, to come up with a feeder device with a straight line movement path. This device is very complicated and due to its construction can only be built into industrial chain stitch sewing machines.

These disadvantages are eliminated by the present invention, which includes a feeder device of the type mentioned which, on the one hand, imparts to the material feeder in the effective area, an approximately rectangular path with very narrow curve transitions between the horizontal thrust segment and the adjacent, at least approximately vertical lift segment and which, on the other hand, is simply constructed and space saving so that it can be used for home, free-arm sewing machines.

To this end the feeder device according to the present invention is characterized by the fact that the support of the material feeder is arranged on an intermediate rocker which, in turn, is rotatingly attached to the thrust rocker, whereby the horizontal rotation axis of the support is arranged on the intermediate rocker at a distance from the rotational axis of the intermediate rocker disposed parallel thereto. The intermediate rocker is, along with the support, set in a vertically oscillating motion and rotated around its rotational axis by a direct connection with the lift rocker, which, by means of the proper correction, provides the movement path of the material feeder, made up of the lift and thrust movements transferred to the support consisting of a lift and a thrust component, at least an approximately rectangular form in the effective area. A particularly advantageous arrangement consists in the configuration wherein the horizontal rotational axis of the support is arranged on the intermediate rocker, nearly vertically, at a distance below the rotational axis connecting the intermediate rocker with the thrust rocker.

Due to the intermediate rocker provided in the present invention, the mentioned transition curves between the horizontal and at least the approximately vertical movement segments in the effective area of the movement path of the material feeder is narrow enough that the horizontal upward movement segment, relative to the maximal thrust length of the material feeder, is not only very large, but is practically identical in both feed directions.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
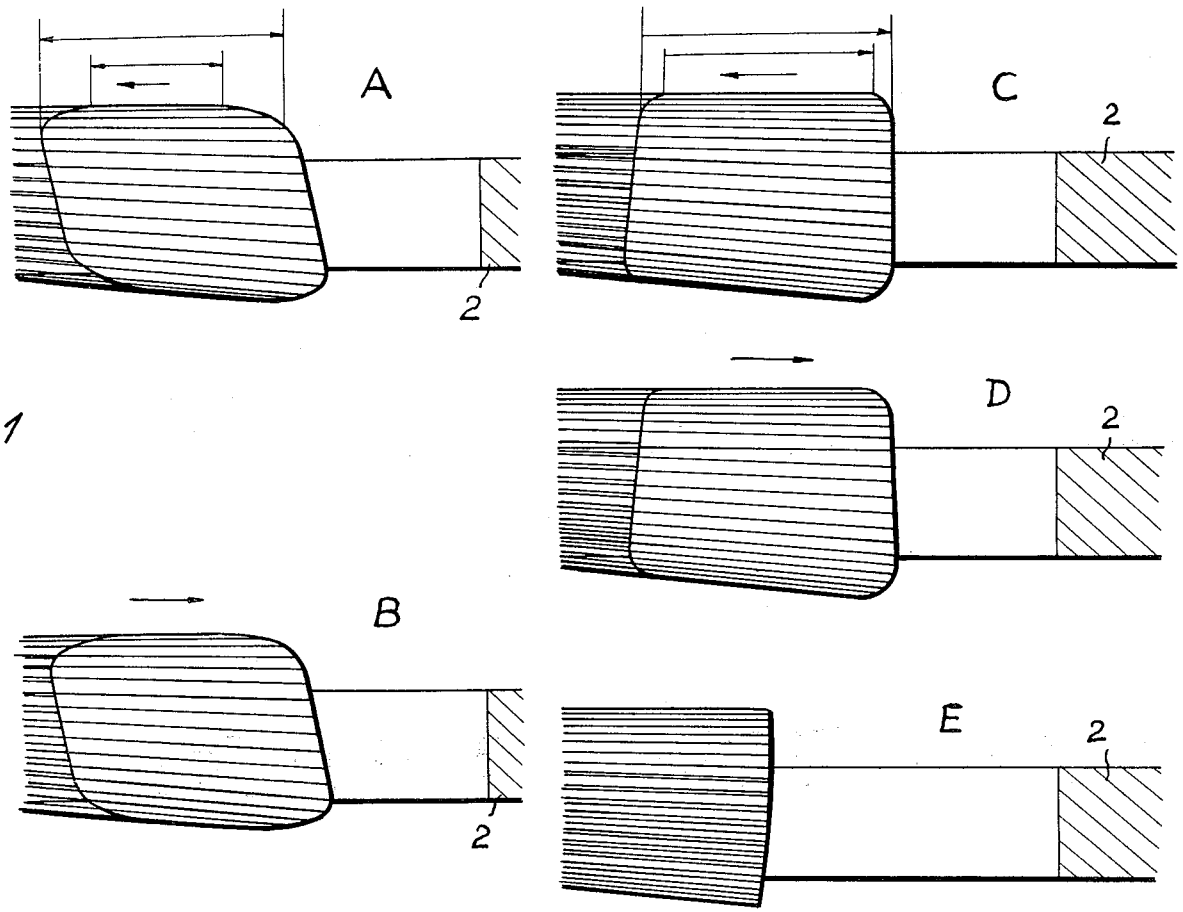
FIG. 1 shows a comparison of the computer drawings of the movement paths of the material feeder with and without an intermediate rocker.
Figure 2:
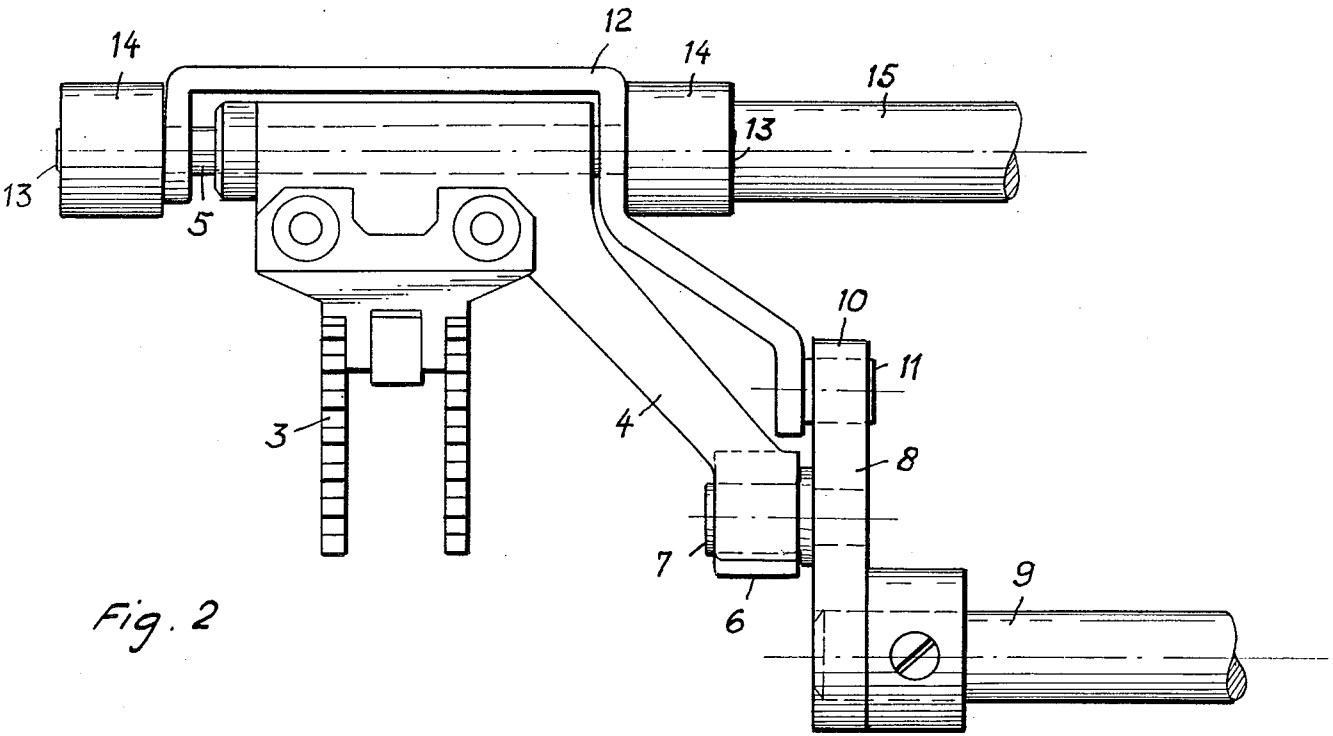
FIG. 2 shows a top view of an example of the feeder device according to the present invention, and FIGS. 3–6 each show a vertical longitudinal section through a device in four different positions of the material feeder.
Figure 3:
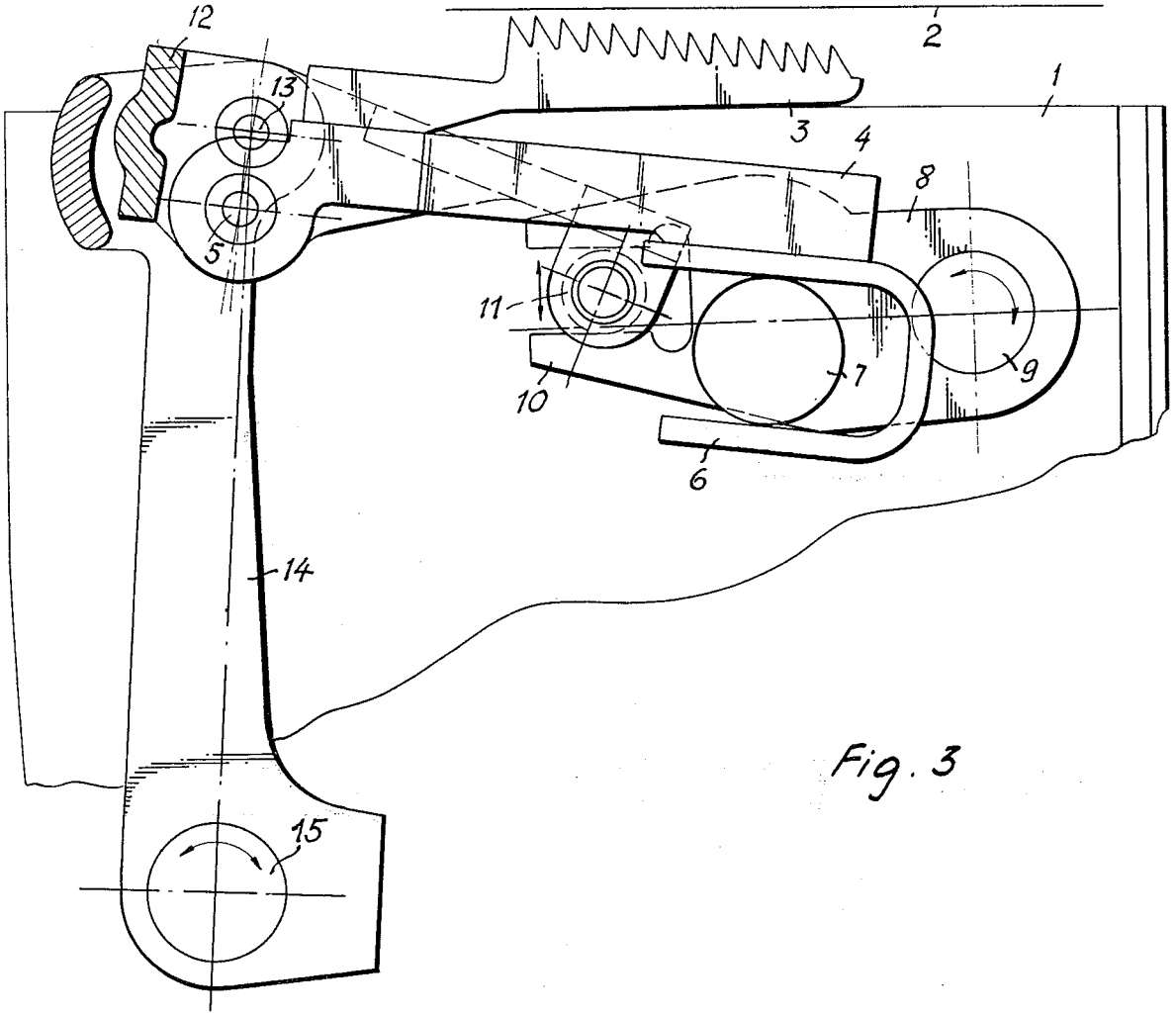
Figure 4:
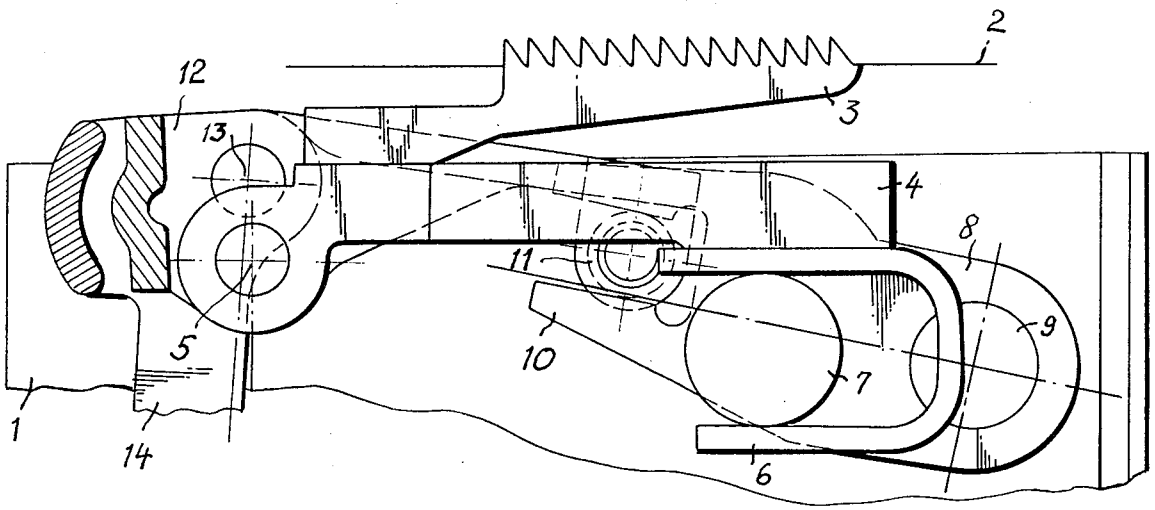
Figure 5:
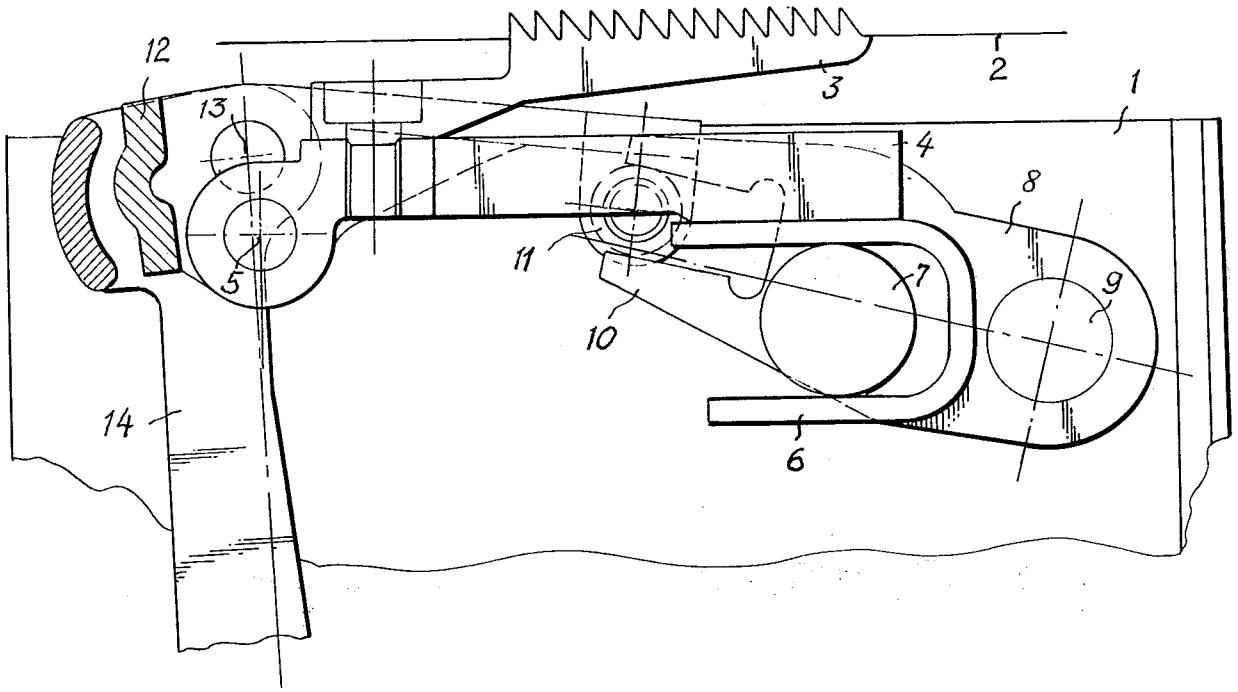
Figure 6:
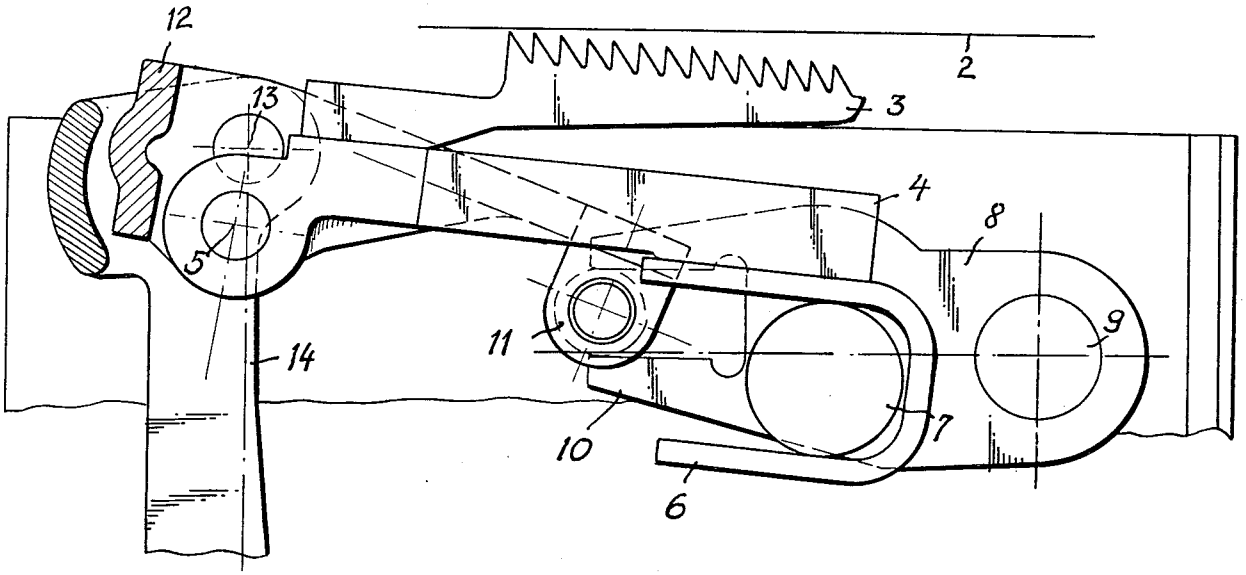

In the drawing the housing of the free arm of a home sewing machine is represented by element 1. The stitch plate with the access opening for the material feeder 3 is designated as element 2. The material feeder 3 is attached to a support 4 which has a horizontal rotational axis 5 on its one end, and at the other end a fork 6. A follower pin 7 is inserted into the fork 6 and is attached to a lift rocker 8. The lift rocker 8, securely attached at one end to a lift rocker shaft 9, has a fork 10 at the other end thereof which is engaged by a follower pin 11 disposed at one end of an intermediate rocker 12. The other end of this intermediate rocker 12 supports the rotational axis 5 of the support 4. Almost vertical above the rotational axis 5 and disposed substantially parallel thereto are axis ends 13, forming the rotational axis of the intermediate rocker 12 mounted in the free end parts of both arms of a thrust rocker 14. The other end of the thrust rocker sits freely on a thrust rocker shaft 15. As can be seen from the drawing, the rotational axis 13 of the intermediate rocker 12 is disposed substantially vertically above the support rotational axis 5.

In operating the described device, i.e., during the oscillating, rotating drive of the lift rocker shaft 9 and the thrust rocker shaft 15, the positions of the material feeder 3 shown in FIGS. 3–6 result from the feed length and the direction, which is determined, for example, by a control connecting link. These four positions, i.e., the bottom front in FIG. 3, the top front in FIG. 4, the top back in FIG. 5 and the bottom back in FIG. 6, form the corner points of the nearly rectangular-shaped movement path of the material feeder 3. In this regard it should be noted that the lift rocker shaft 9 determines the upward or downward movement and the thrust rocker shaft 15 determines the length movement of the material feeder 3, while the intermediate rocker 12, due to its direct connection with the lift rocker 8 and its attachment to the thrust rocker 14, corrects the movement of the support 4 attached thereto, so that not only the steeper lifting movements of the material feeder 3, but also the shorter and, thus, narrower transition curves between the lift and the thrust segments of the material feeding movement are produced.

FIGS. 1A–1D shows the computer drawings of this movement path of an example without as shown in FIGS. 1A and 1B and with the intermediate rocker as shown in FIGS. 1C and 1D to illustrate this correction of the movement path of the material feeder 3. The lines in FIGS. 1A–1E represent the scaming path lines generated by a drawing pin. The drawing pin of the drawing machine controlled by the computer starts from a given point on the left and stops at a calculated value. The calculated values represent the closed geometric figure corresponding to the path of the feeder 3. A shows the forward movement path of the material feeder of the embodiment without the intermediate rocker, whereas FIG. 1B shows the corresponding backward movement path with a similar stitch length setting. It is evident from this that these parallelogram-shaped movement paths clearly show, in the effective area above the stitch plate 2, relatively long transition curves and correspondingly short, definitely horizontal thrust lengths. The two upper transition curves are, in addition, not equal so that the horizontal thrust length with the forward and backward feed FIGS. 1A or 1B do not correspond. In contrast to this the movement paths of the embodiment with an intermediate rocker shown with FIGS. 1C and 1D indicate, at least in the upper effective area, that not only the clearly horizontal thrust segment is several times longer than with FIGS. 1A or 1B and the curve transitions are shorter, but the latter are approximately equal so that, for the forward and backward feed, the horizontal thrust lengths are practically identical. The steepness of the lift segment assures that the start and stop of the transport function of the material feeder can be exactly determined. In addition it is shown in FIG. 1E that with a stitch length set at zero, due to the correcting intermediate rocker, practically equal (in coverage), vertical up and down movements of the material feeder and, thus, a complete standstill in length direction can be achieved. The simple construction of the described feeder device which requires only a few additional parts which also fits completely within the normal space requirement of rockers, supports, and material feeders is particularly suited for incorporation in free-arm sewing machines.

In summary the feed device of the present invention comprises a material feeder 3 which extends through the stitch plate 2 from below. The material feeder sets on a support 4 which is attached through the horizontal rotation axis 5 to an intermediate rocker 12. The rotational axis 13 of the intermediate rocker 12 which lies at a distance above the rotational axis 5 of the support 4 and parallel with respect thereto is attached to thrust rocker 14 which sits securely on a cam driven thrust rocker shaft 15. The intermediate rocker 12 engages a follower pin 11 in a guide fork of a lift rocker 8. The lift rocker 8 in turn engages a guide fork 6 with a follower pin 7, the guide fork 6 being in the support 4. The lift rocker 8 sits securely on a cam drive lift rocker shaft 9. The movement path of the material feeder 3 produced by the effect of the lift and thrust rockers, is corrected by the intermediate rocker 12 so that at least in its effective area lying above the stitch plate 2 it has an approximately rectangular shape. This produces for each selected stitch length a relatively long horizontal feeding movement which is practically identical for forward and reverse stitches.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A feeder device for a sewing machine having a stitch plate comprising:

a material feeder being operatively mounted below said stitch plate and being driven to selectively project through an opening in said stitch plate;

a lift rocker;

a follower pin operatively connected to said lift rocker;

a lift rocker shaft, said lift rocker being operatively connected to said lift rocker shaft;

a thrust rocker;

a thrust rocker shaft, said thrust rocker being operatively connected to said thrust rocker shaft;

an intermediate rocker, said intermediate rocker being operatively connected between said thrust rocker and said lift rocker;

a support;

a guide fork operatively connected to said support;

a support axis;

said follower pin being in engaging relationship with said guide fork and said support being connected to said material feeder and being operatively connected to said support axis, said support axis being mounted on said intermediate rocker at a distance nearly vertically below an axis connecting the intermediate rocker with the thrust rocker;

wherein movement of said lift rocker imparts motion to said material feeder which is constrained to move in substantially horizontal and vertical directions to form an approximate rectangle in an effective area of movement due to the interconnection of the thrust rocker, the intermediate rocker, the lift rocker and the support to project said material feeder through said opening in said stitch plate in a first vertical and a first horizontal direction and to retract said material feeder through said opening in said stitch plate in a retracted vertical direction and a retracted horizontal direction.

2. The feeder device according to claim 1 wherein said material feeder includes teeth for engaging and advancing fabric during sewing.

3. The feeder device according to claim 1 wherein the lift rocker is provided with a guide fork and the intermediate rocker includes a follower pin, said follower pin being in engaging relationship with said guide fork.

* * * * *